US010090102B2

(12) United States Patent
Tsukada et al.

(10) Patent No.: US 10,090,102 B2
(45) **Date of Patent: *Oct. 2, 2018**

(54) METHOD FOR PRODUCING RARE-EARTH SINTERED MAGNET, AND MOLDING MACHINE THEREFOR

(71) Applicant: HITACHI METALS, LTD., Minato-ku, Tokyo (JP)

(72) Inventors: Takashi Tsukada, Kishima-gun (JP); Takuya Nansaka, Kishima-gun (JP); Satoru Kikuchi, Kumagaya (JP)

(73) Assignee: HITACHI METALS, LTD., Tokyo (JP)

( * ) Notice: Subject to any disclaimer, the term of this patent is extended or adjusted under 35 U.S.C. 154(b) by 680 days.

This patent is subject to a terminal disclaimer.

(21) Appl. No.: 14/420,570

(22) PCT Filed: Aug. 12, 2013

(86) PCT No.: PCT/JP2013/071797

§ 371 (c)(1),
(2) Date: Feb. 9, 2015

(87) PCT Pub. No.: WO2014/027638

PCT Pub. Date: Feb. 20, 2014

(65) Prior Publication Data

US 2015/0221433 A1 Aug. 6, 2015

(30) Foreign Application Priority Data

Aug. 13, 2012 (JP) ..... 2012-179163

(51) Int. Cl.
*H01F 1/055* (2006.01)
*H01F 41/02* (2006.01)
(Continued)

(52) U.S. Cl.
CPC ..... *H01F 41/0266* (2013.01); *B22F 3/003* (2013.01); *B22F 3/004* (2013.01);
(Continued)

(58) Field of Classification Search
CPC ..... B22F 3/03; B22F 3/12; B22F 5/00; C22C 33/02; C22C 38/005; H01F 1/0577
(Continued)

(56) References Cited

U.S. PATENT DOCUMENTS 5,489,343 A 2/1996 Uchida et al.
6,413,457 B1 7/2002 Fukushima et al.
(Continued)

FOREIGN PATENT DOCUMENTS

CN 1158176 C 7/2004
JP 07183148 A 7/1995
(Continued)

OTHER PUBLICATIONS

NPL: Machinhe translation of Otsuka et al, JP 2010215992A, Sep. 2010.*

(Continued)

*Primary Examiner* — Jie Yang
(74) *Attorney, Agent, or Firm* — Sughrue Mion, PLLC

(57) ABSTRACT

The present invention provides a method for producing a rare earth sintered magnet and a molding device therefor that can stably mold molded bodies with less variation in unit weight. The method includes: 1) preparing a slurry that includes an alloy powder containing a rare earth element, and a dispersion medium; 2) disposing an upper punch and a lower punch in respective through holes provided in a die, thereby preparing a plurality of cavities; 3) applying a magnetic field in each of the cavities by an electromagnet in a direction substantially parallel to a direction in which at least one of the upper punch and the lower punch is movable,
(Continued)

and then supplying the slurry into the plurality of cavities; 4) producing a molded body of the alloy powder in each of the cavities by press molding in the magnetic field; and 5) sintering the molded body.

2 Claims, 4 Drawing Sheets

(51) Int. Cl.

| | |
|---|---|
| ***C22C 38/00*** | (2006.01) |
| ***C22C 38/06*** | (2006.01) |
| ***C22C 38/10*** | (2006.01) |
| ***C22C 38/16*** | (2006.01) |
| ***B22F 3/03*** | (2006.01) |
| ***B22F 3/087*** | (2006.01) |
| ***B30B 11/00*** | (2006.01) |
| ***B22F 3/00*** | (2006.01) |
| ***B22F 3/12*** | (2006.01) |
| ***B22F 3/22*** | (2006.01) |
| ***B22F 5/00*** | (2006.01) |
| ***C22C 33/02*** | (2006.01) |
| ***H01F 1/08*** | (2006.01) |
| *H01F 1/057* | (2006.01) |

(52) U.S. Cl.
CPC ..... *B22F 3/03* (2013.01); *B22F 3/087* (2013.01); *B22F 3/12* (2013.01); *B22F 3/22* (2013.01); *B22F 5/00* (2013.01); *B30B 11/008* (2013.01); *C22C 33/02* (2013.01); *C22C 38/002* (2013.01); *C22C 38/005* (2013.01); *C22C 38/06* (2013.01); *C22C 38/10* (2013.01); *C22C 38/16* (2013.01); *H01F 1/055* (2013.01); *H01F 1/086* (2013.01); *H01F 41/0273* (2013.01); *H01F 1/0577* (2013.01)

(58) Field of Classification Search
USPC ..... 148/105
See application file for complete search history.

(56) References Cited

U.S. PATENT DOCUMENTS

| | | | | |
|---|---|---|---|---|
| 2006/0219323 | A1 | 10/2006 | Masuzawa et al. | |
| 2007/0176329 | A1 | 8/2007 | Saito et al. | |
| 2015/0206656 | A1* | 7/2015 | Tsukada ..... | C22C 33/02 264/428 |

FOREIGN PATENT DOCUMENTS

| | | | |
|---|---|---|---|
| JP | 8-69908 | A | 3/1996 |
| JP | 2006-253526 | A | 9/2006 |
| JP | 2007-203577 | A | 8/2007 |
| JP | 2010215992 | A | 9/2010 |
| WO | 2005/096331 | A1 | 10/2005 |

OTHER PUBLICATIONS

International Preliminary Report on Patentability, dated Feb. 26, 2015 issued by the International Searching Authority in counterpart Application No. PCT/JP2013/071797.
International Search Report of PCT/JP2013/071797, dated Sep. 3, 2013. [PCT/ISA/210].
Communication dated Mar. 8, 2016, from the European Patent Office in counterpart European Application No. 13879303.9.
Communication dated Oct. 24, 2017 from the European Patent Office in counterpart European application No. 13879303.9.

* cited by examiner

[Fig. 1(a)]
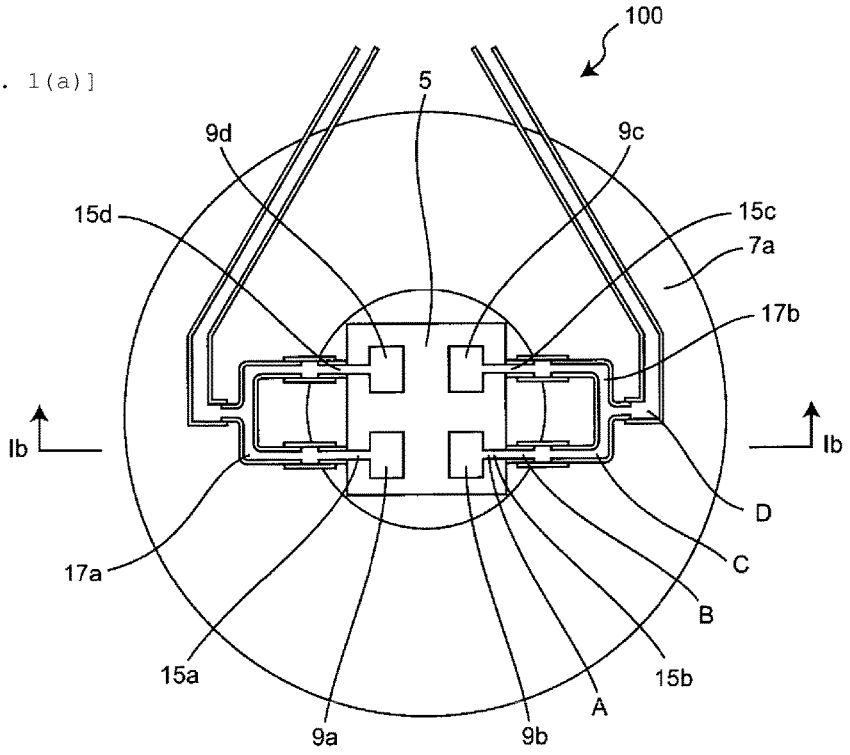
[Fig. 1(b)]
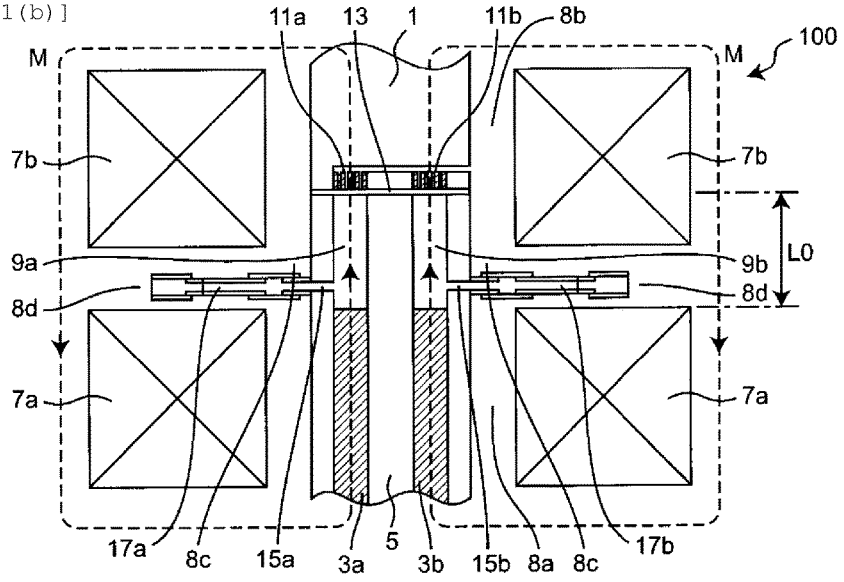

[Fig. 2]
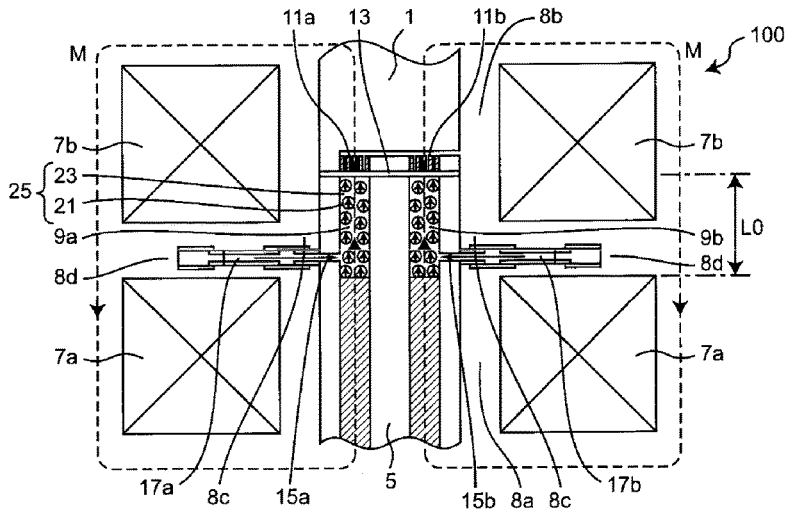
[Fig. 3]
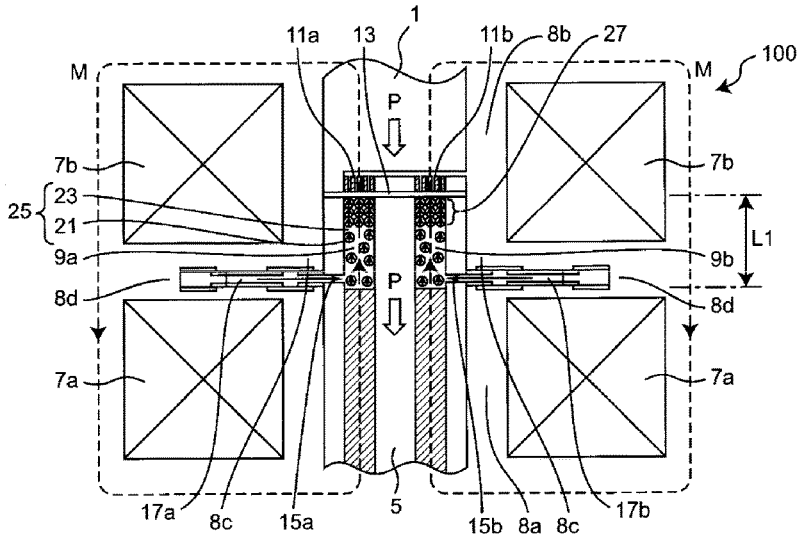

[Fig. 4]
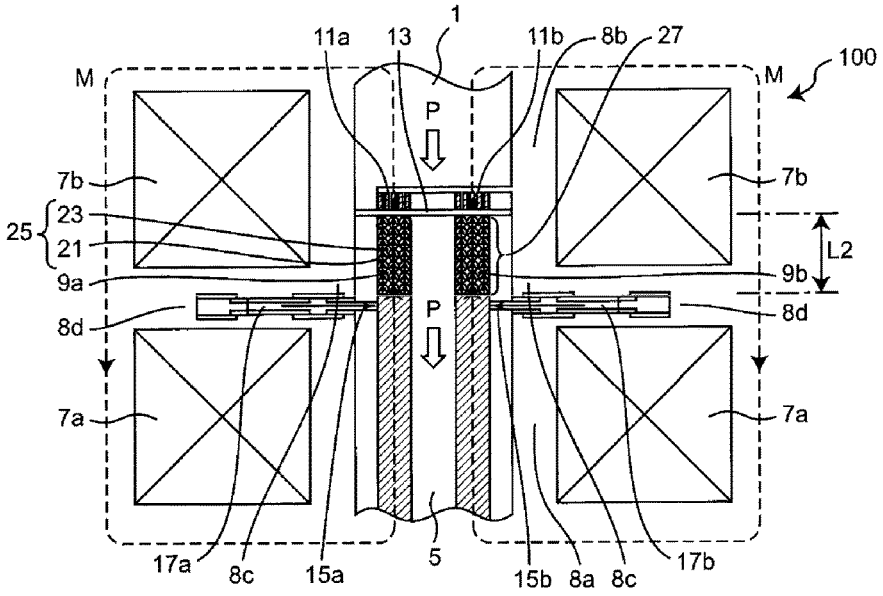

[Fig. 5(a)]
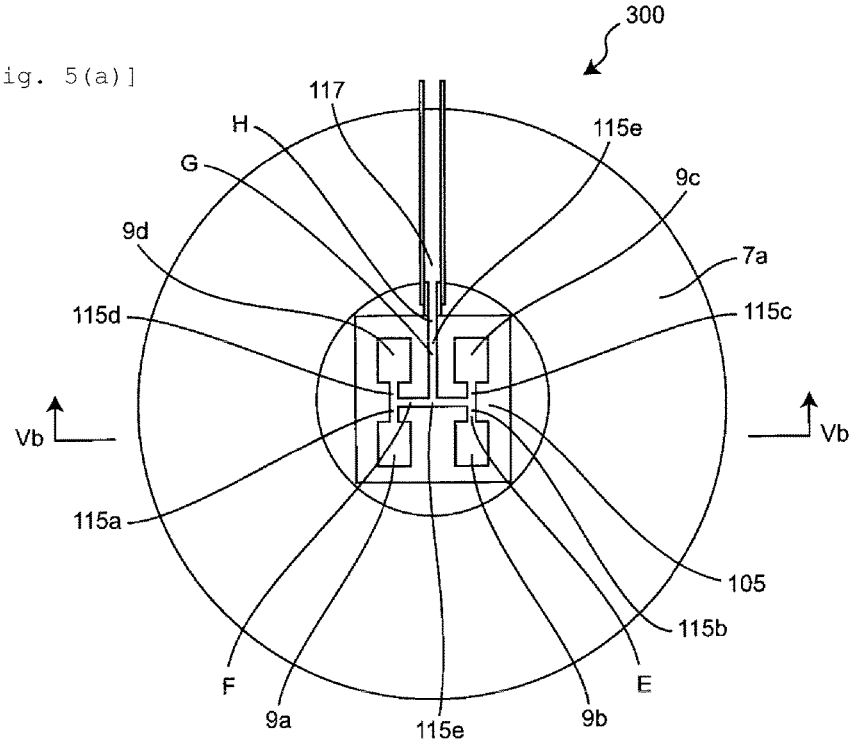
[Fig. 5(b)]
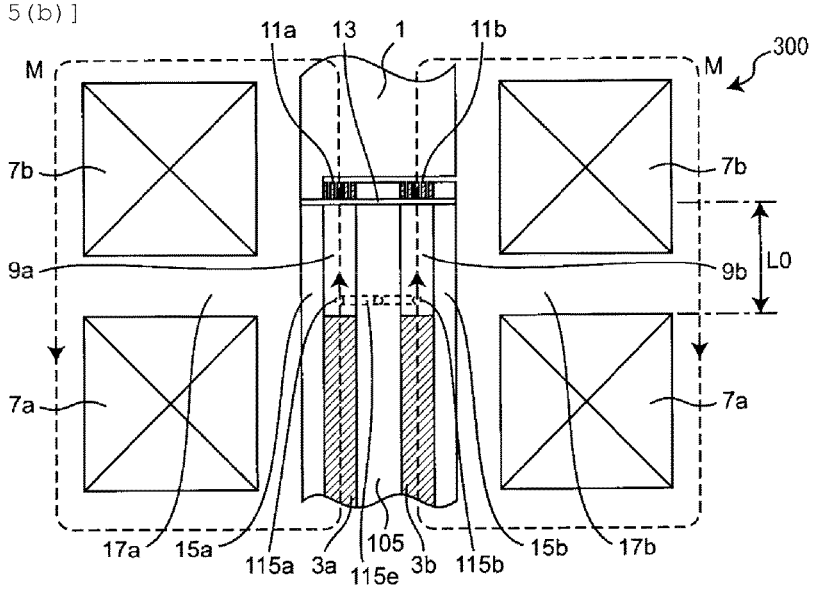

METHOD FOR PRODUCING RARE-EARTH SINTERED MAGNET, AND MOLDING MACHINE THEREFOR

CROSS REFERENCE TO RELATED APPLICATIONS

This application is a National Stage of International Application No. PCT/JP2013/071797 filed Aug. 12, 2013 (claiming priority based on Japanese Patent Application No. 2012-179163, filed Aug. 13, 2012 ), the contents of which are incorporated herein by reference in their entirety.

TECHNICAL FIELD

The present invention relates to a method for producing a rare earth sintered magnet, and more particularly, to a method for producing a rare earth sintered magnet using a wet molding method, and a molding device therefor.

BACKGROUND ART

Rare earth sintered magnets, such as R-T-B-based sintered magnets (R means at least one of rare earth elements (concept including yttrium (Y)), T means iron (Fe) or a combination of iron and cobalt (Co), and B means boron) and Sm—Co-based sintered magnets (samarium (Sm) may be partially substituted with other rare earth elements) are widely used because of excellent magnetic characteristics such as a residual magnetic flux density $B_r$ (hereinafter sometimes simply referred to as "$B_r$") and a coercive force $H_{cj}$ (hereinafter sometimes simply referred to as "$H_{cj}$").

Particularly, the R-T-B based sintered magnet has the highest magnetic energy product among various magnets hitherto known, and is relatively inexpensive. Thus, the R-T-B based sintered magnet has been used for various applications, including various motors, such as a voice coil motor for a hard disc drive, a motor for a hybrid vehicle, and a motor for an electric vehicle, and home electric appliances. In recent years, in order to achieve the reduction in size and weight or higher efficiency of products for various applications, the rare earth sintered magnets, such as the R-T-B based sintered magnet, are required to further improve its magnetic characteristics.

The production of most of the rare earth sintered magnets including an R-T-B-based sintered magnet includes the following steps of:

obtaining a raw material alloy cast with a desired composition, such as an ingot produced by melting (fusing) raw materials for examples metals and casting the molten raw materials in a die to obtain an ingot, or strip produced by a strip cast method, and grinding the raw material alloy cast to produce alloy powder having a predetermined particle diameter; and press molding the alloy powder (press molding the alloy powder in a magnetic field) to produce a molded body (green compact), and then sintering the molded body.

In the case of obtaining an alloy powder from a casting material, in many cases, steps to be used are two grinding steps of a coarsely grinding step of grinding into a coarse powder having a large particle diameter (coarsely ground powder) and a finely grinding step of further grinding the coarse powder into an alloy powder having a desired particle diameter.

The method of press molding (press molding in a magnetic field) is roughly classified into two methods. One is a dry molding method in which the obtained alloy powder is subjected to press molding in a dry state. The other one is a wet molding method mentioned, for example, in Patent Document 1, in which an alloy powder is dispersed in a dispersion medium such as oil to prepare a slurry, and the alloy powder is supplied in a cavity of a die in a state of the slurry, followed by press molding.

Furthermore, the dry molding method and the wet molding method can be roughly classified into two methods, respectively, according to a relation between the pressing direction at the time of pressing in a magnetic field and the direction of the magnetic field. One is a perpendicular magnetic field molding method (also referred to as a "transverse magnetic field molding method") in which the direction of compression performed by a press (pressing direction) is orthogonal to the direction of the magnetic field applied to an alloy powder. The other one is a parallel magnetic field molding method in which the pressing direction is in parallel with the direction of a magnetic field applied to an alloy powder (also referred to as a "longitudinal magnetic field molding method").

There is a need for the wet molding method to perform supply of a slurry and removal of a dispersion medium, and thus the structure of a molding device becomes comparatively complicated. However, oxidation of the alloy powder and the molded body is suppressed by the dispersion medium, thus enabling reduction in the amount of oxygen of the molded body. The dispersion medium exists between alloy powders at the time of press molding in the magnetic field, leading to weak restriction due to a friction force. Thus, the alloy powder can rotates more easily in the magnetic field application direction. Therefore, higher orientation degree can be obtained. Thus, it is possible to obtain a rare earth sintered magnet which is more excellent in magnetic characteristics as compared with the dry molding method.

High orientation degree and excellent oxidation suppressing effect obtained using the wet molding method can be obtained in not only this R-T-B-based sintered magnet, but also other rare earth sintered magnets.

Among the wet molding methods, especially, the use of the parallel magnetic field molding method can achieve the more excellent magnetic characteristics based on the following reasons.

In the wet molding method, when the slurry is charged in a cavity and press molding is performed in the magnetic field, there is a need for most of a dispersion medium (oil, etc.) in the slurry to be discharge out of the cavity. Usually, at least one of an upper punch and a lower punch is provided with a dispersion medium outlet and, when the volume of the cavity decreases by the movement of the upper punch and/or the lower punch to pressurize the slurry, the dispersion medium is discharged through the dispersion medium outlet. In this case, since the dispersion medium in the slurry is filtered and discharged from the portion close to the dispersion medium outlet, a layer called a "cake layer" having increased concentration (high density) of the alloy powder is formed at the portion close to the dispersion medium outlet in an initial stage of press molding.

As the upper punch and/or the lower punch move (s) and press molding proceeds, much more dispersion medium is filtered and discharged, and thus an area of the cake layer spreads in the cavity. Finally, the cake layer having high density of the alloy powder (low dispersion medium concentration) spreads all over the cavity, resulting in achieving bonding between the alloy powders (comparatively weak bonding) to obtain a molded body.

In the initial stage of press molding, when the cake layer is formed at the portion close to the dispersion medium outlet (upper portion and/or lower portion in the cavity), the direction of the magnetic field tends to be curved in the perpendicular magnetic field molding method.

The cake layer exhibits increased magnetic permeability as compared with the portion other than the cake layer of the slurry (portion with less amount of the alloy powder per unit volume) because of high density of the alloy powder (large amount of the alloy powder per unit volume), thus causing focusing of the magnetic field in the cake layer. This means the fact that, even if the magnetic field is applied approximately perpendicularly to the cavity side surface outside the cavity, the magnetic field is curved to the cake layer inside the cavity. Therefore, since the alloy powder is oriented along this curved magnetic field, the portion with curved orientation exists in the molded body after press molding, leading to a decrease in orientation degree in the single molded body, thus failing to obtain sufficient magnetic characteristics in the sintered magnet.

Meanwhile, in the parallel magnetic field molding method, since the magnetic field is applied to the direction parallel to the pressing direction, i.e. the direction parallel to the direction from the upper punch toward the lower punch, even if the cake layer is formed at the portion close to the dispersion medium outlet of the upper punch and/or the lower punch, the magnetic field travels straight toward the inside of the cake layer from the portion where the cake layer does not exist without being curved. Therefore, this does not cause the bending of the orientation of the magnetic field, unlike the perpendicular magnetic molding method.

Patent Document 1: JP 8-69908 A

DISCLOSURE OF THE INVENTION

Problems to be Solved by the Invention

Conventionally, in order to improve the productivity, a plurality of through holes are formed in a die for use in pressing under the magnetic field, and the upper punch and lower punch are disposed at the respective through holes, so that a plurality of cavities is disposed in the magnetic field. The slurry is supplied to the respective cavities to perform press molding in each cavity, whereby a plurality of molded bodies are produced.

However, conventionally, the strength of the magnetic field applied in the parallel magnetic field molding method is about 1.0 T, thus scarcely recognizing clear variations in weight of molded bodies produced obtained by the plurality of the cavities.

In recent years, in order to obtain the more excellent magnetic characteristics, it is often necessary to perform press molding in the magnetic field by applying a stronger magnetic field than before. However, as the magnetic field to be applied increases, for example to more than 1.0 T, variations in weight of the molded body may be recognized. Particularly, increased magnetic field to be applied, for example, 1.5 Tor more, may cause a problem such as variations in weight of molded body produced (hereinafter referred to as "unit weight variation" in some cases. Note that the term "unit weight" as used herein means the weight of one molded body).

The unit weight variation leads to variations in size of the obtained molded body. In the case of a large variation in size, a target size needs to be set larger so that the small-sized molded body does not become a defective. As a result, a number of molded bodies that are larger than a necessary size thereof are fabricated. In some cases, it is necessary to reduce the size of the large-sized modified bodies fabricated, by cutting and/or polishing or the like, which leads to an increase in cost for material or processing. The large unit weight variation sometimes leads to variations in magnetic characteristics.

Therefore, the unit weight variation of the molded body is required to be reduced.

Accordingly, it is an object of the present invention to provide a method for producing a rare earth sintered magnet and a molding device therefor that can stably mold molded bodies with less variation in unit weight even though a large magnetic field, for example, exceeding 1.0 T (for example, 1.1 T or more, and further 1.5 T or more) is applied during press molding in the magnetic field, by disposing a plurality of cavities in the magnetic field.

Means for Solving the Problems

A first aspect of the present invention is directed to a method for producing a rare earth sintered magnet, including the steps of: 1) preparing a slurry that includes an alloy powder containing a rare earth element, and a dispersion medium; 2) disposing an upper punch and a lower punch in respective through holes provided in a die, thereby preparing a plurality of cavities enclosed by the die, and the upper punch and the lower punch, at least one of the upper punch and the lower punch being movable toward and away from the other one, the upper punch and the lower punch including an outlet for discharging the dispersion medium of the slurry; 3) applying a magnetic field in each of the cavities by an electromagnet in a direction substantially parallel to a direction in which at least one of the upper punch and the lower punch is movable, and then supplying the slurry into the plurality of cavities via a plurality of slurry supply paths extending from an outer peripheral side surface of the die to each of the cavities without being branched; 4) producing a molded body of the alloy powder in each of the cavities by press molding in the magnetic field in which the upper punch and the lower punch come closer to each other while applying the magnetic field; and 5) sintering the molded body.

A second aspect of the present invention is directed to the production method according to the first aspect, wherein the electromagnet includes a first electromagnet, and a second electromagnet opposed to and spaced from the first electromagnet.

A third aspect of the present invention is directed to the production method according to the second aspect, which comprises supplying the slurry in the plurality of slurry supply paths through a slurry flow path disposed between the first electromagnet and the second electromagnet.

A fourth aspect of the present invention is directed to the production method according to any one of the first to third aspects, wherein the slurry supply path of each of the plurality of the cavities linearly extends from the outer peripheral side surface of the die toward the cavity.

A fifth aspect of the present invention is directed to the production method according to any one of the first to fourth aspects, wherein, in the step 3), the slurry is supplied into each of the plurality of the cavities at a flow rate of 20 to 600 $cm^3$/second.

A sixth aspect of the present invention is directed to the production method according to any one of the first to fifth aspects, wherein a strength of the magnetic field is 1.5 T or more.

A seventh aspect of the present invention is directed to a molding device for a rare earth sintered magnet, including: an upper punch and a lower punch, at least one of which is movable toward and away from the other one; a die having a plurality of through holes, the die including a plurality of cavities, each of the plurality of cavities being enclosed by the upper and lower punches disposed in each of the plurality of through holes, and the through holes; an electromagnet for applying a magnetic field in each of the plurality of the cavities in a direction substantially parallel to a direction in which at least one of the upper and lower punches is movable; and a plurality of slurry supply paths extending from an outer peripheral side surface of the die to each of the plurality of the cavities without being branched, the slurry supply paths being capable of supplying a slurry including an alloy powder and a dispersion medium to the plurality of the cavities.

An eighth aspect of the present invention is directed to the molding device according to the seventh aspect, wherein the electromagnet includes: a first electromagnet, and a second electromagnet opposed to and spaced from the first electromagnet.

A ninth aspect of the present invention is directed to the molding device according to the seventh or eighth aspect, which is capable of supplying the slurry in the plurality of slurry supply paths through a slurry flow path disposed between the first electromagnet and the second electromagnet.

A tenth aspect of the present invention is directed to the molding device according to any one of claims the seventh to ninth aspects, wherein the slurry supply path of each of the plurality of the cavities linearly extends from the outer peripheral side surface of the die toward the cavity.

Effects of the Invention

The use of the production method or molding device according to the present invention can stably mold the molded bodies with little variation in unit weight even though a plurality of cavities are disposed in a magnetic field and large magnetic field, for example, exceeding 1.0 T is applied to the plurality of the cavities. As a result, costs for material and processing can be reduced.

BRIEF DESCRIPTION OF THE DRAWINGS

FIGS. 1 (*a*) and 1 (*b*) are sectional views of a production device of a rare earth sintered magnet according to the present invention, more specifically, sectional views of a press molding device 100 in a magnetic field, in which FIG. 1 (*a*) shows a cross-sectional view thereof, and FIG. 1 (*b*) shows a section taken along the line Ib-Ib of FIG. 1 (*a*).

FIG. 2 is a sectional view showing a state in which cavities 9*a* to 9*d* (cavities 9*c* and 9*d* not shown in the drawing) are filled with a slurry 25.

FIG. 3 shows a state in which the cavities 9*a* to 9*d* (cavities 9*c* and 9*d* not shown in the drawing) are compressed such that a length of the cavities in a molding direction is L1.

FIG. 4 shows a state in which the cavities 9*a* to 9*d* (cavities 9*c* and 9*d* not shown in the drawing) are compressed such that a length of the cavities in a molding direction is L2 that is substantially equal to a length LF of a molded body to be obtained.

FIGS. 5 (*a*) and 5 (*b*) are sectional views sowing a conventional press molding device 300 in the magnetic field, in which FIG. 5 (*a*) shows a cross section thereof, and FIG. 5 (*b*) shows a section taken along the line Vb-Vb of FIG. 5 (*a*).

MODE FOR CARRYING OUT THE INVENTION

Preferred embodiments of the present invention will be described in detail below with reference to the accompanying drawings. In the description below, if necessary, the terms indicative of the specific direction or position (for example, "upper", "lower", "right", "left", and other words including these words) are used for easy understanding of the present invention with reference to the drawings. The meanings of the terms do not limit the scope of the present invention in the present application. The same parts or members are designated by the same reference numerals throughout the drawings.

The inventors have intensively studied the reason that when forming a molded body by press molding in a high magnetic field, for example, exceeding 1.0 T (for example, 1.1 T or more, further 1.5 T or more) by providing one die with a plurality of through holes to dispose a plurality of cavities, using a conventional method, a unit weight variation occurs between a plurality of molded bodies.

As a result, as will be mentioned in detail later, in the conventional slurry supply method, a slurry supply path for introducing a slurry into a die from an outer peripheral side surface of the die was branched and the slurry was supplied into each of the cavities. Thus, it has been found that the existence of the branch portion leads to variations in weight of molded bodies obtained between cavities, thus causing unit weight variation.

When a slurry supply path for injecting a slurry into each of a plurality of cavities is formed therein without forming the branch portion so as to connect the cavity with the outer peripheral side surface of the die, it is possible to obtain molded bodies with less variation in unit weight even though a large magnetic field, for example, exceeding 1.0 T, for example, 1.5 T or more, is applied. In this way, the present invention has been made.

The production method and device according to the present invention will be described in detail below.

1. Press Molding Step in Magnetic Field (1) Press Molding Device in Magnetic Field FIGS. 1 (*a*) and 1 (*b*) are sectional views of a production device of a rare earth sintered magnet according to the present invention, more specifically, sectional views of a press molding device 100 in a magnetic field, in which FIG. 1 (*a*) shows a cross-sectional view thereof, and FIG. 1 (*b*) shows a section taken along the line Ib-Ib of FIG. 1 (*a*). Note that actually, a first electromagnet 7*a* does not exist on a cross sectional surface shown in FIG. 1 (*a*) (as will be understood from FIG. 1 (*b*), the first electromagnet 7*a* is disposed under the sectional surface shown in FIG. 1 (*a*)). For easy understanding of the relative positional relationship between the first electromagnet 7*a* and other components shown in FIG. 1 (*a*), the first electromagnet 7*a* is illustrated in FIG. 1 (*a*).

The press molding device 100 in the magnetic field includes the first electromagnet 7*a* having a space 8*a* (hollow) vertically penetrating therethrough (in the vertical direction shown in FIG. 1 (*b*)); a second electromagnet 7*b* opposed to the upper portion of the first electromagnet 7*a* and positioned away from the first electromagnet 7*a*, the second electromagnet 7*b* having a space (hollow) 8*b* vertically penetrating therethrough (in the vertical direction shown in FIG. 1 (*b*)); and a die 5 extending from the space 8*a* of the first electromagnet 7*a* to the space 8*b* of the second electromagnet 7*b* (that is, one part of the die being accommodated in the space 8*a* of the first electromagnet 7*a*, and extending between the space 8*a* of the first electromagnet 7*a* and the space 8*b* of the second electromagnet 7*b*, and another part of the die being accommodated in the space 8*b* of the second electromagnet 7*b*).

In the embodiment shown in FIGS. 1 (*a*) and 1 (*b*) (hereinafter referred to as a simply "FIG. 1" by combination of both the drawings in some cases), spaces 8*a* and 8*b* have the same shape (column) and are coaxially arranged in order to generate the more uniform magnetic field within the space 8*a* of the first electromagnet 7*a* and the space 8*b* of the second electromagnet 7*b*. As long as the die 5 can be disposed and the relatively uniform magnetic field can be generated within the space 8*a* and the space 8*b*, the spaces 8*a* and 8*b* may have any shape and be disposed in any arrangement.

In one preferred embodiment, in order to generate a uniform magnetic field therein, the space 8*a* serves as an air core (core portion) of a coil of the first electromagnet 7*a*, and the space 8*b* serves as an air core (core portion) of a coil of the second electromagnet 7*b*.

FIG. 1 shows the embodiment using two electromagnets 7*a* and 7*b*. Instead of this, however, one electromagnet may be used to position at least a part of the die 5 within a space (for example, air core) vertically penetrating the electromagnet.

Furthermore, the present invention also includes, for example, the embodiment using three or more electromagnets, like the embodiment in which the first electromagnet 7*a* is composed of two electromagnets disposed proximally in the vertical direction and also the second electromagnet 7*b* is composed of two electromagnets disposed proximally in the vertical direction, thus using four electromagnets in total.

In the embodiment shown in FIG. 1, a part of the die 5 extends from the space 8*a* of the first electromagnet 7*a* to the space 8*b* of the second electromagnet 7*b*. That is, a part of the die 5 is accommodated in the space 8*a* of the first electromagnet 7*a*, extends between the space 8*a* of the first electromagnet 7*a* and the space 8*b* of the second electromagnet 7*b*, and another part of the die 5 is accommodated in the space 8*b* of the second electromagnet 7*b*. Instead of this, the die 5 is disposed in at least one of spaces 8*c* and 8*d*. This embodiment is also included in the present invention. The space 8*c* is a space connecting between the space 8*a* of the first electromagnet 7*a* and the space 8*b* of the second electromagnet 7*b* (a space positioned between the space 8*a* and the space 8*b*). A space 8*d* is a space (opposed space) between the first electromagnet 7*a* and the second electromagnet 7*b*.

The die 5 has therein a plurality of cavities. A description is made of the case where four cavities 9*a* to 9*d* are formed in the die 5 based on FIG. 1. The number of cavities may be any number of 2 or more. Preferably, the die 5 includes four or more cavities, and more preferably eight or more cavities. This is because higher productivity can be obtained.

In the embodiment shown in FIG. 1, a plurality of through holes is provided in one die 5 to thereby form a plurality of cavities. Instead of this, however, a plurality of dies is used with one or a plurality of through holes formed in each die to form a plurality of cavities. Such an embodiment is also included in the present invention.

Cavities 9*a* to 9*d* each are formed of four through holes vertically penetrating the die 5 (in the vertical direction shown in FIG. 1 (*b*)), an upper punch 1 disposed to cover the four through holes, and four lower punches 3*a* to 3*d* respectively inserted into lower portions of the four through holes. That is, each of the cavities 9*a* to 9*d* is formed to be enclosed by an inner surface of the through hole of the die 5, a lower surface of the upper punch 1, and an upper surface of one of the lower punches 3*a* to 3*d* (that is, an upper surface of the lower punch having a reference character with the same letter of the alphabet as that of a reference character of the cavity).

Each of the cavities 9*a* to 9*d* has a length L0 along the molding direction. The term "molding direction" as used herein means a direction in which at least one of the upper and lower punches moves so as to get close to the other one (that is, in the pressing direction).

In the embodiment shown in FIG. 1, the lower punches 3*a* to 3*d* are fixed, and the upper punch 1 and the die 5 are integrally moved as will be mentioned later. Thus, the direction from the upper side to the lower side in FIG. 1(*b*) (direction indicated by arrows P in FIGS. 3 and 4) is the molding direction.

Broken lines M in FIG. 1(*b*) schematically show a magnetic field formed by the first electromagnet 7*a* and the second electromagnet 7*b*. Within each of the cavities 9*a* to 9*d* (note that the cavities 9*c* and 9*d* are not shown in FIG. 1 (*b*)), the magnetic field is applied from the lower side to the upper side in FIG. 1, that is, in the direction substantially parallel to the molding direction as indicated by the arrows on the broken lines M. As shown in FIG. 1 (*b*), the term "substantially parallel to the molding direction" as used herein means not only the direction of the magnetic field from the lower punches 3*a* to 3*d* (lower punches 3*c* and 3*d* not shown) to the upper punch 1 (from the lower side to the upper side in FIG. 1 (*b*)), but also the reverse direction thereto, that is, the direction of the magnetic field from the upper punch 1 to the lower punches 3*a* to 3*d* (from the upper side to the lower side in FIG. 1 (*b*)).

The reason for use of the terms "substantially parallel" and "substantially" is that for example, like the magnetic field in the air core of the coil, the magnetic field formed in the space (hollow) provided within the electromagnet exhibits not a completely straight line, but a gentle curved line, and thus is not completely parallel to the straight molding direction. Note that based on understanding of these facts, a person skilled in the art sometimes expresses that the magnetic field on the gentle curved line is "parallel" to the longitudinal direction of the coil (vertical direction of FIG. 1 (*b*), that is, the same direction as the molding direction). Thus, in light of technical common sense to the person skilled in the art, the term "parallel" may be used without any problems.

The strength of the magnetic field of the inside of each of the cavities 9*a* to 9*d* preferably exceeds 1.0 T (for example, 1.1 T or more), and more preferably 1.5 T or more. This is because the magnetization direction of alloy powder in the slurry is surely oriented in the direction of the magnetic field upon supplying the slurry into the respective cavities 9*a* to 9*d*, which provides the high degree of orientation. The strength of the magnetic field in the cavity is 1.0 T or lower, which may decrease the degree of orientation of the alloy powder, or may easily disturb the orientation of the alloy powder during the press molding. The strength of the magnetic field of the inside of the cavity 9 can be determined by measurement with a gaussmeter or analysis of the magnetic field.

Note that in the present invention, as will be mentioned later, when the magnetic field exceeding 1.0 T is applied in the cavities 9*a* to 9*d*, the significant effect is exhibited.

However, also even when applying the magnetic field of 1.0 T or less, obviously, the molded bodies with little variation in unit weight can be stably molded.

The die 5 is preferably formed of non-magnetic material so as to form the magnetic field substantially parallel to the molding direction within each of the cavities 9*a* to 9*d*. Such a non-magnetic material can be a non-magnetic cemented carbide by way of example.

The upper punch 1 and lower punches 3*a* to 3*d* are preferably made of magnetic material (ferromagnetic material). In order to form the uniform parallel magnetic fields inside the cavities 9*a* to 9*d*, a non-magnetic material may be disposed on the lower end surface of the upper punch or the upper end surface of the lower punch.

The cavities 9*a* to 9*d* include slurry supply paths 15*a* to 15*d*, respectively (that is, each cavity includes the slurry supply path having a reference numeral with the same letter of the alphabet as that of a reference numeral showing the cavity). The slurry supply paths 15*a* to 15*d* formed to allow the slurry to pass therethrough extend from the outer peripheral side surface (outer periphery) of the die to the respective cavities 9*a* to 9*d* without having the branch portion.

The slurry supply paths 15*a* to 15*d* are connected to the slurry flow path 17*a* or slurry flow path 17*b* for supplying the slurry from the outside to the die 5 as will be mentioned in detail.

In order to explain the reason that such structure enables suppression of weight unit variation of the molded body formed in the cavities 9*a* to 9*d*, a description is made by comparing with the structure of a conventional press molding device in the magnetic field.

FIG. 5 is a sectional view of a conventional press molding device 300 in the magnetic field, in which FIG. 5 (*a*) shows a cross section thereof, and FIG. 5 (*b*) shows a section taken along the line Vb-Vb of FIG. 5 (*a*). Note that actually, a first electromagnet 7*a* does not exist on a cross sectional surface shown in FIG. 5 (*a*) (as will be understood from FIG. 5 (*b*), the first electromagnet 7*a* is disposed under the sectional surface shown in FIG. 5 (*a*)). For easy understanding of the relative positional relationship between the first electromagnet 7*a* and other components shown in FIG. 5 (*a*), the first electromagnet 7*a* is illustrated in FIG. 5(*a*), likewise FIG. 1 (*a*).

The slurry supply paths 115*a*, 115*b* and 115*e* do not exist on a section taken along the line Vb-Vb (as is apparent from FIG. 5 (*a*), the slurry supply paths 115*a*, 115*b* and 115*e* exist in the deep side of a paper surface of FIG. 5 (*b*)), and they are indicated by the dotted line for easy understanding of the positional relationship with the cavities 9*a*, 9*b*.

In FIGS. 5 (*a*) and 5 (*b*) (hereinafter referred to as a simply "FIG. 5" by combination of both the drawings in some cases), the component denoted by the same reference character has the same structure as that shown in FIG. 1, unless otherwise specified.

Ina die 105 of a press molding device 300, supply of a slurry into a plurality of cavities 9*a* to 9*d* of the die 105 is performed by slurry supply paths 115*a* to 115*e* extending from outer peripheral side surfaces of the die 105 to the cavities 9*a* to 9*d*. The slurry supply paths are composed of a slurry supply path 115*e* for introducing a slurry from the outer peripheral side surface of the die 105 into the die 105, and slurry supply paths 115*a* to 115*d* that are branched from the slurry supply path 115*e* to thereby connect each of the cavities 9*a* to 9*d*.

More specifically, the slurry supply path 115*a* extends from the outer peripheral side surface of the die 105 toward the center and then branched into two directions by a T-shaped branch portion. Furthermore, the slurry supply path 115*a* and the slurry supply path 115*d* are branched in a T-shape from one of these two branch portions, while the slurry supply path 115*b* and the slurry supply path 115*c* are branched in a T-shape from the other one.

The end portion on the outer peripheral side surface of the slurry supply path 115*e* is connected to a slurry flow path 117 disposed between the first electromagnet 7*a* and the second electromagnet 7*b*.

In this way, the slurry supply paths 115*a* to 115*g* are provided in the die 105, whereby only one connection between the slurry flow path 117 and the die 105 (the end of the slurry supply path 115*e* on a side of the outer periphery of the die) can advantageously supply the slurry to the cavities 9*a* to 9*d*.

However, the inventors have found out that when applying a magnetic field exceeding 1.0 T (for example, 1.1 T or more, further 1.5 T or more) in order to obtain the high magnetic characteristics, such a structure is more likely to have the unit weight variation of the molded bodies.

The reason for occurrence of the unit weight variation between the cavities that is considered by the inventors will be as follows. It is noted that this is not intended to restrict the scope of the present invention.

The alloy powder in the slurry supplied into the cavities 9*a* to 9*d* is oriented in parallel to the direction of the magnetic field by receiving the magnetic field applied. However, the orientation of the alloy powder in the magnetic field direction is not restricted to the inside of the cavity. The alloy powder existing in the slurry supply paths 115*a* to 115*e* is also oriented in the magnetic field direction.

That is, the alloy powder sometimes aggregates in the form of agglomerate by the magnetic field in the direction orthogonal to the traveling direction of the slurry in the slurry supply paths 115*a* to 115*e*. Such alloy powder in the form of agglomerate becomes the resistance to the slurry progressing in the traveling direction. Within the die 105, as the movement distance of the slurry becomes longer and the branch portion exists, the slurry receives more resistance. When the magnetic field is relative small, e.g., 1.0 T or less, these variations in resistance due to the long movement distance of the slurry and the presence of the branch portion are not considered to be so problematic.

When the applied magnetic field exceeds 1.0 T, however, the degree of orientation of the alloy powder becomes relatively high. In this case, the presence of the branch portion becomes a main cause for the unit weight variation of the molded body. When the branch point exists in the slurry supply path in the die, even though two slurry supply paths are geometrically (for example, the same sectional shape and the same angle) branched in the same manner (for example, the supply path 115*a* and slurry supply path 115*d*), the resistance to the slurry differs between two slurry supply paths depending on a difference in amount or shape of the alloy powder aggregating due to the magnetic field close to the branch portion, which often leads to large variations in unit weight between the cavities. As a result, this can be considered to assist in variations in magnetic characteristics of the thus obtained rare earth sintered magnet.

To the contrary, the press molding device 100 in the magnetic field according to the present invention shown in FIG. 1 is provided with slurry supply paths 15*a* to 15*d* so as not to have the branch portion in the die 5.

The slurry supply paths 15*a* to 15*d* respectively extend from the outer peripheral side surfaces of the die 5 up to the cavities 9*a* to 9*d* (i.e. the slurry supply paths 15*a* extends from the outer peripheral side surfaces of the die 5 up to the cavity 9*a*, the slurry supply paths 15*b* extends from the outer peripheral side surfaces of the die 5 up to the cavity 9*b*, the slurry supply path 15*c* extends from the outer peripheral side surfaces of the die 5 up to the cavity 9*c*, and the slurry supply path 15*d* extends from the outer peripheral side surfaces of the die 5 up to the cavity 9*d*). The slurry supply paths 15*a* to 15*d* having such structure include no branch portion, thus enabling supply of the slurry from the outer peripheral side surfaces of the die 5 up to the cavity without allowing the slurry to pass through the branch portion. That is, the slurry supply paths 15*a* to 15*d* can drastically decrease the difference in resistance between the cavities upon supply of the slurry and can surely reduce weight unit variation.

The slurry supply paths 15*a* to 15*d* preferably have the same length (length within the die 5). This is because the difference in resistance between the slurry supply paths can be more surely suppressed.

The slurry supply paths 15*a* to 15*d* preferably extend linearly (that is, have no curved part and curved part). Suppose that the slurry supply portion has the curved or curved part with the magnetic field of above 1.0 T applied thereto, and the alloy powder oriented in the magnetic field direction aggregates in this part, such a part obviously becomes a large resistance to the fluidity of the slurry as compared to the formation of a straight linear part.

Referring to FIG. 1, the slurry supply paths 15*a* to 15*c* are provided in parts where a distance between each of the cavities 9*a* to 9*d* and the outer peripheral side surface of the die 5 is relatively short. In this way, the length of each of the slurry supply paths 15*a* to 15*d* can be shortened, which can surely decrease the resistance to the fluidity of the slurry. Thus, the slurry can surely be uniformly supplied to the cavities 9*a* to 9*d*.

Note that when there is a plurality of positions where a distance between each of the cavities 9*a* to 9*d* and the outer peripheral side surface of the die 5 is short, one of the slurry supply paths 15*a* to 15*d* may be provided in any one of the positions.

When each of the cavities 9*a* to 9*d* has an optimal position for setting the cavity side end (slurry supply port) of each of the slurry supply paths 15*a* to 15*d* depending on the shape of a molded body to be obtained, the depth of the cavity, and the like, the slurry supply paths 15*a* to 15*d* are not necessarily provided in the parts where a distance between each of the cavities 9*a* to 9*d* and the outer peripheral side surface of the die 5 is short. Even though the length of each of the slurry supply path 15*a* to 15*d* is slightly long, the slurry supply paths 15*a* to 15*d* preferably extend from the optimal positions.

The slurry supply paths 9*a* to 9*d* are connected to the slurry flow path 17*a* or 17*b* that is connected to a slurry supply device (not shown) (for example, a hydraulic device having a hydraulic cylinder), which allows the slurry from being supplied from the slurry supply device to the cavities 9*a* to 9*d*.

As shown in FIG. 1, the slurry flow path 17*a* and the slurry flow path 17*b* are preferably disposed between the first electromagnet 7*a* (more specifically, a coil portion of the first electromagnet 7*a* (part not serving as an air core)) and the second electromagnet 7*b* (more specifically, a coil portion of the second electromagnet 7*b* (part not serving as an air core)). The part between the first and second electromagnets 7*a* and 7*b* has the strength of its magnetic field reduced to, e.g., a half or less of the magnetic field strength of the air core. Thus, the resistance to the slurry flowing through the slurry flow paths 17*a* and 17*b* due to the magnetic field is weak as compared to that of the air core.

Thus, as shown in FIG. 1 (*a*), the slurry flow paths 17*a* and 17*b* may have a branch portion, which is not problematic.

As shown in FIG. 1, the number of the slurry flow paths may be plural or single depending on the arrangement of the slurry supply paths.

The slurry flow path may be made of any material as long as the slurry flow path has a resistance to pressure of the slurry passing therethrough and has the resistance to corrosion or dissolution by a dispersion medium of the slurry. Preferably, the material for the slurry flow path is, for example, a copper (for example, copper pipe), or a stainless steel. A pressure-resistant rubber may also be used.

The shape of the slurry flow path has any shape that has a small resistance upon flowing of the slurry and which hardly causes the retention of the slurry. A pipe or the formation of a hole penetrating a block-like member may form the slurry flow path.

In the above-mentioned preferable embodiment, the slurry flow paths 17*a* and 17*b* are disposed between the first electromagnet 7*a* and the second electromagnet 7*b*. However, the slurry flow paths 17*a* and 17*b* are not limited thereto, and may have any arrangement. For example, in use of a single electromagnet instead of the first electromagnet 7*a* and the second electromagnet 7*b*, the slurry flow path may be disposed to extend from the outside of the coil of the electromagnet to the air core through the coil.

The upper punch 1 preferably includes a dispersion medium outlet 11*a* that filters to discharge the dispersion medium in the slurry out of the cavity 9*a*. In a more preferable embodiment, the dispersion medium outlet 11*a* has a plurality of outlets.

Likewise, the upper punch 1 preferably has dispersion medium outlets 11*b* to 11*d* that filters to discharge the dispersion medium so as to filter to discharge the dispersion medium to the outside of the cavities 9*b* to 9*d* (note that the dispersion medium outlet 11*c* (for discharging the dispersion medium in the cavity 9*c*) and the dispersion medium discharge hole 11*d* (for discharging the dispersion medium in the cavity 9*d*) are not shown in the drawings).

In case the upper punch 1 includes the dispersion medium outlets 11*a* to 11*d*, the upper punch 1 preferably has a filter 13, e.g., a molding filter cloth, a molding filter paper, a porous filter, or a metal filter, so that the filter 13 covers the dispersion medium outlets 11*a* to 11*d*. This prevents the alloy powder from coming into the dispersion medium outlets 11*a* to 11*d* more securely (i.e. only the dispersion medium passes through), thus making it possible to filter the dispersion medium in the slurry to discharge out of the cavities 9*a* to 9*d*.

Instead of or in addition to providing the dispersion medium outlets 11*a* to 11*d* in the upper punch 1, the dispersion medium outlet 11*a* may be provided in the lower punch 3*a*, the dispersion medium outlet 11*b* may be provided in the lower punch 3*b*, the dispersion medium outlet 11*c* may be provided in the lower punch 3*c*, and the dispersion medium outlet 11*d* may be provided in the lower punch 3*d*.

In this way, even when the lower punches 3*a* to 3*d* are provided with the dispersion medium outlets 11*a* to 11*d*, the filters 13 are preferably disposed in the respective lower punches 3*a* to 3*d* to cover the dispersion medium outlets 11*a* to 11*d*, respectively.

(2) Press Molding Method

Supply of Slurry

The details of the step of press molding using the press molding device 100 in the magnetic field will be described below. As shown in FIG. 1 (*b*), the upper punch 1 and the die 5 are fixed to predetermined positions, thereby setting the respective heights of the cavities 9*a* to 9*d* to an initial height L0.

Then, the slurry is injected into the cavities 9*a* to 9*d*.

As mentioned above, the slurry is charged via a slurry supply device (not shown), the slurry flow paths 17*a* and 17*b*, and the slurry supply paths 9*a* to 9*d*.

FIG. 2 is a sectional view showing a state in which the cavities 9*a* to 9*d* (cavities 9*c* and 9*d* not shown in the drawing) are filled with the slurry 25. The slurry 25 includes an alloy powder 21 containing a rare earth element, and a dispersion medium 23, such as oil. In the state shown in FIG. 2, the upper punch 1 and the lower punches 3*a* to 3*d* are in a static state, and thus the length in the molding direction of each of the cavities 9*a* to 9*d* (that is, the distance between the upper punch 1 and the lower punch 3 (3*a* to 3*d*)) is kept L0.

The slurry 25 is preferably supplied into each of the cavities 9*a* to 9*d* at a flow rate of 20 to 600 $cm^3$/second (in an amount of supply of the slurry). At the flow rate of less than 20 $cm^3$/second, the magnetic field whose strength exceeds 1.0 T is applied, making it difficult to adjust the flow rate. Further, at the flow rate of less than 20 $cm^3$/second, the slurry cannot be supplied into the cavity due to the resistance by the magnetic fields. On the other hand, when the flow rate exceeds 600 $cm^3$/second, there occur variations in density of the thus obtained molded body, which may generate cracks in the molded body when removing the molded body after the press molding, or generate cracks due to contraction thereof in sintering. When the flow rate exceeds 600 $cm^3$/second, the disturbance of the orientation can be caused close to the slurry supply port. Particularly, when the dimension of the cavity in the magnetic field application direction (height of the cavity) exceeds 10 mm, the flow rate of the slurry is preferably in a range of 20 to 600 $cm^3$/second.

The flow rate of the slurry is more preferably in a range of 20 to 400 $cm^3$/second, and most preferably 20 to 200 $cm^3$/second. By setting the flow rate of the slurry to the more preferable range and further the most preferable range, variations in density between respective parts of the molded body can be further reduced.

The flow rate of slurry can be controlled by adjusting a flow rate adjustment valve of the hydraulic device with the hydraulic cylinder serving as the slurry supply device to change the flow rate of oil to be fed to the hydraulic cylinder, thereby changing the speed of the hydraulic cylinder.

When a molded body is produced by supplying the slurry into the cavity at a flow rate of 20 $cm^3$/second to 600 $cm^3$/second while the magnetic field exceeding 1.0 T is applied into the cavity, the thus obtained molded body can reduce variations in density of the respective parts of the molded body. As a result, the magnetic characteristics of respective parts of the rare earth sintered magnet obtained from the molded body have the uniform and high magnetic characteristics, which can further suppress variations in magnetic characteristics between the cavities.

The slurry is preferably supplied under a pressure of 1.96 MPa to 14.71 MPa (20 $kgf/cm^2$ to 150 $kgf/cm^2$).

The slurry supply paths 15*a* to 15*d* have any sectional shape (section orthogonal to the traveling direction of the slurry). One of the preferred shapes is substantially a circle, whose diameter is preferably in a range of 2 mm to 30 mm.

A magnetization direction of the alloy powder 21 of the slurry 25 supplied in cavities 9*a* to 9*d* becomes in parallel with the direction of the magnetic field, i.e., in parallel with the molding direction, due to the magnetic field of exceeding 1.0 T applied in the cavity. In FIGS. 2 to 4, arrows in the alloy powder 21 schematically indicate the magnetization direction of the alloy powder 21.

Press Molding

The press molding is performed after the cavities 9*a* to 9*d* are filled with the supplied slurry 25 in this way.

FIG. 3 and FIG. 4 are schematic cross-sectional view schematically showing press molding.

FIG. 3 shows a state where compression was performed until the length of the cavities 9*a* to 9*d* (the cavities 9*c* and 9*d* are not shown) in molding direction becomes L1 (L0>L1), and FIG. 4 shows a state where compression was performed until the length of the cavities 9*a* to 9*d* (the cavities 9*c* and 9*d* are not shown) in molding direction becomes L2 (L1>L2) which is equal to the length LF of the molded body to be obtained.

The press molding is performed so that at least one of the upper punch 1 and the lower punch 3 (lower punches 3*a* to 3*d*) is moved to cause the upper punch 1 and the lower punch 3 (lower punches 3*a* to 3*d*) to come close to each other, whereby, the each volume of the cavities 9*a* to 9*d* is reduced. In the embodiments as shown in FIG. 1 and FIG. 4, the lower punches 3*a* to 3*d* are fixed, and the upper punch 1 and the second electromagnet 7*b*, and the die 5 and the first electromagnet 7*a* are respectively integrated. That is, the upper punch 1, the second electromagnet 7*b*, the die 5 and the first electromagnet 7*a* integrally travels in the direction of an arrow P in FIG. 3 and FIG. 4 (from the top to the bottom in the drawings), thus performing press molding.

As shown in FIG. 3, when the press molding is performed in the magnetic field and thus the volumes of the cavities 9*a* to 9*d* decrease, the dispersion medium 23 in the slurry 25 is filtered to discharge through the dispersion medium outlets 11*a* to 11*d* from the portion close to the dispersion medium outlets 11*a* to 11*d*. On the other hand the alloy powders 21 remain in the cavities 9*a* to 9*d*. Thereafter, as shown in FIG. 4, the cake layer 27 spreads all over the cavities 9*a* to 9*d*, resulting in achieving bonding between the alloy powders 21 to obtain a molded body in which the length in the molding direction (length in the compression direction) is LF. As used herein, "cake layer" means a layer of which concentration of alloy powder becomes high due to filtering and discharge of the dispersion medium in the slurry to the outside of the cavities 9*a* to 9*d* (in a so-called cake-shaped state in many cases).

In the press molding in magnetic field according to the invention of the present application, a ratio (L0/LF) between a length (L0) of the cavities 9*a* to 9*d* in the molding direction before the press molding is performed and a length (LF) of the obtained molded body in the molding direction is preferably within a range of 1.1 to 1.4. When the ratio L0/LF is 1.1 to 1.4, a risk that the alloy powder 21 of which magnetization direction is oriented to a direction of the magnetic field rotates by a force applied when the alloy powder is subjected to the press molding, and thus the magnetization direction thereof deviates from a direction in parallel with the magnetic field can be reduced. This ensures achieving a further improvement in magnetic characteristics. To obtain the ratio L0/LF of 1.1 to 1.4, a method of increasing the concentration of the slurry to a high value (for example, concentration of 84% by mass or more) is exemplified.

In the embodiments shown in FIG. 1 to FIG. 4, the lower punches 3*a* to 3*d* are fixed, and the upper punch 1 and the die 5 are integrally moved to perform press molding in the magnetic field. However, there is no limitation.

A movable upper punch that can be inserted into the through hole of the upper punch die 5 (that is, like the lower punches 3*a* to 3*d*) may be used to fix the die 5, and move the movable upper punch downward and the lower punches 3*a* to 3*d* upward.

As a modified example of the embodiment shown in FIG. 1, the die 5 and the upper punch 1 may be fixed, and the lower punches 3*a* to 3*d* may be moved in upward direction of FIG. 1 (*b*), thereby performing the pressing in the magnetic field.

2. Other Steps

Steps other than the molding step will be described below.

(1) Production of Slurry

Composition of Alloy Powder

An alloy powder may have the composition of a known rare earth sintered magnet including R-T-B-based sintered magnets (R means at least one of rare earth elements (concept including yttrium (Y)), T means iron (Fe) or a combination of iron and cobalt (Co), and B means boron) and Sm—Co-based sintered magnets (samarium (Sm) may be partially substituted with other rare earth elements).

An R-T-B-based sintered magnet is preferable because of the highest magnetic energy product among various magnets and the affordable low price.

Preferable composition of the R-T-B-based sintered magnet is shown below.

R is selected from at least one of Nd, Pr, Dy and Tb. However, it is preferable that R contains either one of Nd and Pr. It is more preferable that a combination of the rare earth elements represented by Nd—Dy, Nd—Tb, Nd—Pr—Dy or Nd—Pr—Tb is used.

Among R, Dy and Tb particularly exert the effect of improving $H_{cJ}$. The alloy powder may contain a small amount of another rare earth element, such as Ce or La. The element R is not necessarily a pure element (e.g. misch metal or didymium can be used) and may include inevitable impurities as long as it is available for industrial use. The content of the element R may be conventionally known content, and preferably can be within a range of 25 to 35% by mass. For the content of the element R of less than 25% by mass, the alloy powder cannot sometimes obtain the adequate magnetic characteristics, especially, the high $H_{cJ}$. On the other hand, for the content of the element R exceeding 35% by mass, $B_r$ may be sometimes reduced.

The element T contains iron (including the case where T is substantially composed of iron), and may be substituted with cobalt (Co) by 50% by mass or less thereof (including the case where T is substantially composed of iron and cobalt). The element Co is effective for improving the temperature characteristics and corrosion resistance, and the alloy powder may contain 10% by mass or less of Co. The content of the element T occupies the balance of R and B, or R and B and below-mentioned M.

The content of the element B may be known content, and preferably may be within a range of 0.9 to 1.2% by mass. For the content of the element B of 0.9% by mass or less, the alloy powder cannot sometimes obtain the high $H_{cJ}$. On the other hand, for the content of the element B of 1.2% by mass or more, $B_r$ may be sometimes reduced. A part of the elements B may be substituted with the element C (carbon). The substitution with the element C has the effect of improving the corrosion resistance of the magnet. In adding the elements B and C (including the case where both B and C are included), the total content of the elements B and C is preferably controlled so as to have the above preferable content of the element B by converting the number of substituent C atoms into the number of B atoms.

In addition to the above elements, the element M can be added for improving $H_{cJ}$. The element M is at least one element selected from the group consisting of Al, Si, Ti, V, Cr, Mn, Ni, Cu, Zn, Ga, Zr, Nb, Mo, In, Sn, Hf, Ta, and W. The amount of addition of the element M is preferably 2.0% by mass or less. When the addition amount of the element M exceeds 5.0% by mass, $B_r$ may be sometimes reduced. Inevitable impurities can be permitted.

Method for Producing Alloy Powder

The alloy powder is obtained in the following manner, for example, an ingot or a flake of a raw material alloy for a rare earth sintered magnet having a desired composition is produced by a melting method, and hydrogen is absorbed (stored) in the ingot of the flake, thus performing hydrogen grinding to obtain a coarsely ground power.

Then, the coarsely ground power is further ground by a jet mill to obtain a fine powder (alloy powder).

A method for producing a raw material alloy for a rare earth sintered magnet will be exemplified below.

The alloy ingot is obtainable by an ingot casting method in which metal with finally required composition prepared in advance is melted and poured into a mold.

The alloy flake can be produced by a quenching method typified by a strip casting method or a centrifugal casting method in which a solidified alloy thinner than an alloy produced by an ingot casting method is quenched by bringing the molten metal into contact with a single roll, a twin roll, a rotation disk or a rotating cylinder mold.

In the present invention, a material produced by either one of the ingot casting method or the quenching method can be used. However, a material produced by the quenching method is preferred.

The raw material alloy (quenched alloy) for a rare earth sintered magnet, produced by the quenching method, usually has a thickness within a range of 0.03 mm to 10 mm and has a flake shape. The molten alloy starts solidification from a surface in contact with a cooling roll (roll contact surface), and a crystal grain grows into a columnar shape in a thickness direction from the roll contact surface. The quenched alloy is cooled within a shorter period of time as compared with the alloy (ingot alloy) produced by a conventional ingot casting method (mold casting method), and thus the structure is refined, leading to a small crystal grain diameter. The quenched alloy has a wide grain boundary area. Since an R-rich phase expands largely within the grain boundary, the quenching method is excellent in dispersibility of the R-rich phase.

Therefore, the quenched alloy is likely to undergo grain boundary fracture by the hydrogen grinding method. The hydrogen grinding of the quenched alloy can control an average size of the hydrogen-ground powder (coarsely ground power) within a range of 1.0 mm or less.

The coarsely ground powder thus obtained is ground, for example, by a jet mill to obtain an alloy powder having a D50 grain size of 3 to 7 μm as measured by an airflow dispersion type laser analysis method.

The jet mill is preferably used in (a) atmosphere composed of a nitrogen gas and/or an argon gas (Ar gas) substantially having an oxygen content of 0% by mass, or (b) atmosphere composed of a nitrogen gas and/or an Ar gas having an oxygen content of 0.005 to 0.5% by mass.

In order to control the amount of nitrogen in the obtained sintered body, the atmosphere in the jet mill is replaced by an Ar gas atmosphere, and then a trace amount of a nitrogen gas is introduced thereinto to adjust the concentration of the nitrogen gas in the Ar gas.

Dispersion Medium

A dispersion medium is a liquid capable of obtaining a slurry by dispersing an alloy powder therein.

Examples of preferable dispersion medium to be used in the present invention include mineral oil and synthetic oil.

Although the kind of mineral oil or synthetic oil is not specified, when kinematic viscosity at normal temperature exceeds 10 cSt, the viscosity increases to enhance cohesion between alloy powders, and thus an adverse influence may be sometimes exerted on orientation property of the alloy powder when wet molding is performed in magnetism.

Therefore, the kinematic viscosity at the normal temperature of mineral oil or synthetic fluid is preferably 10 cSt or less. When a fractional distillation point of mineral oil or synthetic oil exceeds 400° C., it becomes difficult to perform deoiling after obtaining the molded body. As a result, the residual carbon amount in the sintered body may increase to cause deterioration of magnetic characteristics.

Therefore, the fractional distillation point of mineral oil or synthetic oil to be used as the dispersion medium is preferably 400° C. or lower.

It is also possible to use vegetable oil as the dispersion medium. The vegetable oil means oil extracted from plants and is not limited to oil extracted from specific kinds of plants. Examples of the vegetable oil include soybean oil, rapeseed oil, corn oil, safflower oil and sunflower oil.

Preparation of Slurry

Slurry can be obtained by mixing the obtained alloy powder with a dispersion medium.

There is no particular limitation on a mixing ratio of the alloy powder to the dispersion medium, and the concentration of the alloy powder in the slurry is preferably 70% or more (i.e., 70% by mass or more) in terms of a mass ratio. This is because, the alloy powder can be efficiently supplied in the cavity at a flow rate within a range of 20 to 600 $cm^3$/second, and also excellent magnetic characteristics are obtained.

The concentration of the alloy powder in the slurry is preferably 90% or less in a mass ratio. This is because fluidity of the slurry is certainly ensured.

More preferably, the concentration of the alloy powder in the slurry is within a range of 75% to 88% in a mass ratio. This is because the alloy powder can be supplies more efficiently, and also fluidity of the slurry is ensured more certainly.

Still more preferably, the concentration of the alloy powder in the slurry is 84% or more in a mass ratio. As mentioned above, it is possible to adjust a ratio (L0/LF) of the length (L0) of the cavity 9 in molding direction to the length (LF) of the obtained molded body in the molding direction to a low value within a range of 1.1 to 1.4, thus enabling a further improvement in magnetic characteristics.

There is no particular limitation on the method for mixing the alloy powder with dispersion medium.

An alloy powder and a dispersion medium are separately prepared and, followed by weighing of predetermined amount of them to produce a mixture.

Alternatively, in the case of dry grinding of a coarsely ground powder by jet mill to obtain an alloy powder, a container accommodating a dispersion medium is disposed at an alloy powder discharging opening of a grinder such as a jet mill, and the alloy powder obtained by grinding is directly collected in the dispersion medium accommodated in the container to obtain a slurry. In this case, it is preferable that the container is also placed under atmosphere composed of a nitrogen gas and/or an argon gas, and then obtained alloy powder is directly collected into the container of dispersion medium without exposing the alloy powder to atmospheric air to prepare a slurry.

It is also possible that the coarsely ground powder kept in dispersion medium is wet-ground in a state of being held in the dispersion medium using a vibration mill, a ball mill or an attritor to obtain a slurry composed of the alloy powder and the dispersion medium.

(2) Deoiling Treatment

A dispersion medium such as mineral oil or synthetic oil remains in the molded body obtained by the above mentioned wet molding method (longitudinal magnetic field forming method).

When the temperature of the molded body in this state is raised rapidly from normal temperature to, for example, 950 to 1,150° C., which is a sintering temperature, the inner temperature of the molded body rises rapidly, and thus the dispersion medium remaining in the molded body may react with a rare earth element of the molded body to produce rare earth carbide. In this way, when the rare earth carbide is produced, generation of a liquid phase sufficient for sintering is suppressed, thus failing to obtain a sintered body having sufficient density to cause deterioration of magnetic characteristics.

Therefore, before sintering, the molded body is preferably subjected to a deoiling treatment. The deoiling treatment is preferably performed under the conditions at 50 to 500° C., and more preferably 50 to 250° C., under a pressure of 13.3 Pa ($10^{-1}$ Torr) or less for 30 minutes or more. This is because that the dispersion medium remaining in the molded body can be sufficiently removed.

A heating and holding temperature of the deoiling treatment is not limited to a single temperature as long as the heating and holding temperature is within a range of 50 to 500° C., and the deoiling treatment may be performed at two or more different temperatures. It is also possible to obtain the same effect as in the case of to the above mentioned preferable deoiling treatment by subjected to a deoiling treatment under the conditions of a pressure of 13.3 Pa ($10^{-1}$ Torr) or less and a heating rate of from room temperature to 500° C. of 10° C./minute or less, more preferably 5° C./minute or less.

(3) Sintering

Sintering of the molded body is preferably performed under a pressure of 0.13 Pa ($10^{-3}$ Torr) or less, and more preferably 0.07 Pa ($5.0\times10^{-4}$ Torr) or less, at a temperature within a range of 1,000° C. to 1,150° C. In order to avoid oxidation by sintering, it is preferable to replace the remaining gas of atmosphere by inert gas such as helium and argon.

(4) Heat Treatment

The obtained sintered body is preferably subjected to a heat treatment. By the heat treatment, the magnetic characteristics can be enhanced. Publicly known conditions can be employed for the heat treatment, e.g., temperature of the heat treatment and time for the heat treatment.

EXAMPLES

Example 1

When a magnetic field of 1.50 T (in the direction indicated by the arrow with a broken line M of FIG. 1 (*b*)) was generated within the cavities 9*a* to 9*d* of the press molding device 100 (Example 1) in the magnetic field shown in FIG. 1, the strength of the magnetic field in each of positions A, B, C and D in the drawing was determined by the magnetic field analysis. As Comparative Example, when a magnetic field (in the direction of arrow indicated by the broken line M of FIG. 5 (*b*)) is generated in cavities 9*a* to 9*d* (each having the same size as that of each of cavities 9*a* to 9*d* in FIG. 1) of a press molding device 300 including the branch portion in the die 105 (Comparative Example 1) in the magnetic field of 1.50 T (in the direction of arrow indicated by the broken line M of FIG. 5 (*b*)) shown in FIG. 5, each strength of the magnetic fields in positions E, F, G and H shown in the drawing was determined by the magnetic field analysis in the same manner.

The magnetic field analysis was performed by inputting various conditions for the press molding devices in the magnetic field shown in FIGS. 1 and 5 by use of an ANSYS (manufactured by a Cybernet Systems Co., Ltd.), which is a commercially available analysis tool, and analyzing the magnetic field on the assumption that no slurry was supplied. The results of these measurements were shown in Table 1.

TABLE 1

| | Example 1 | | | | Comparative Example 1 | | | |
|---|---|---|---|---|---|---|---|---|
| Position | A | B | C | D | E | F | G | H |
| Magnetic field strength (T) | 1.50 | 1.30 | 0.61 | 0.37 | 1.50 | 1.50 | 1.50 | 1.50 |

As shown in Table 1, it is found that in both Example 1 and Comparative Example 1, the magnetic field strength of each of the positions (A of Example 1, E to H of Comparative Example 1) in the die was 1.50 T.

To the contrary, the positions B in the vicinity of the die 5 of the slurry flow paths 17*b* of Example 1 shows slightly small magnetic field strength, for example, 1.30 T. The position C in the vicinity of the branch portion of the slurry flow paths 17*b* and that of the position D in the vicinity of the bent portion, located between electromagnets 7*a* and 7*b*, respectively show small magnetic field strength, for example, 0.61 T and 0.37 T.

Therefore, it is apparent that a large influence is not exerted on flow of the slurry (i.e. supply of a slurry to cavities) in the press molding method in the magnetic field according to the present invention in which the slurry is supplied into the cavities through a slurry supply path including no branch portion in an inside of a die 5 to which large magnetic field of 1.50 T or more is applied.

Meanwhile, it is apparent that a large influence is exerted on flow of the slurry by large magnetic field in a conventional press molding method in the magnetic field in which the branch portion is included in an inside of a die 105 in which large magnetic field exists.

Example 2

An alloy molten metal was obtained by melting an alloy in a high-frequency melting furnace so as to have a composition (% by mass) of $Nd_{20.7}Pr_{5.5}Dy_{5.5}B_{1.0}Co_{2.0}Al_{0.1}Cu_{0.1}$ and the balance of Fe. The thus-obtained alloy molten metal was quenched by a strip cast method, thereby producing a flaky alloy of 0.5 mm in thickness. The alloy was coarsely ground by a hydrogen grinding method, and then ground into fine particles by nitrogen gas containing an oxygen content of 10 ppm (0.001% by mass, that is, substantially 0% by mass) by a jet mill. A particle diameter D50 of the thus obtained alloy powder was 4.7 μm. The alloy powder was immersed in mineral oil having a distillation point of 250° C. and a kinetic viscosity of 2 cSt at room temperature (manufactured by Idemitsu Kosan Co., Ltd., Trade name: MC OIL P-02) under nitrogen atmosphere, thereby providing a slurry in a concentration of 85% (% by mass).

The press molding was performed by using the press molding device 100 in the magnetic field according to the present invention shown in FIG. 1 (Example 2), and a conventional press molding device 300 in the magnetic field, including the branch portion in a die 105, shown in FIG. 5 (Comparative Example 2). The die used had a rectangular sectional shape. After applying a static magnetic field having a magnetic field strength of 1.5 T (in the direction indicated by the arrow in a broken line M of FIG. 1 and FIG. 5) into the cavity in the depth direction of each of the cavities 9*a* to 9*d*, the slurry was supplied into the cavities 9*a* to 9*d* at a flow rate of the slurry of 200 $cm^3$/second and at a slurry supply pressure of 5.88 MPa by a slurry supply device (not shown). After filling the cavities 9*a* to 9*d* with the slurry, the press molding was carried out at the molding pressure of 98 MPa (0.4 ton/$cm^2$) such that a ratio (L0/LF) of the length (L0) of the cavity to the length (LF) of the molded body after the molding was 1.25.

In both Example 2 and Comparative Example 2, one time of the above step was defined as one shot. The molding process was carried out for forty shots to obtain one hundred and sixty molded bodies in total. Note that the length (depth) L0 of the cavity was adjusted such that the molded body after the sintering had a target weight of 100 g.

The thus-obtained molded body was heated at a rate of 1.5° C./minute from room temperature to 150° C. under vacuum, and then kept at that temperature for one hour. Thereafter, the molded body was heated again up to 500° C. at a rate of 1.5° C./minute, thereby removing the mineral oil from the molded body. Further, the molded body was heated at 20° C./minute from 500° C. to 1,100° C., and maintained at that temperature for 2 hours and sintered. The thus obtained sintered body was subjected to a heat treatment for one hour at 900° C., and then another heat treatment for one hour at 600° C.

Variations in weight (unit weight) of the thus obtained sintered body (Example 2 and Comparative Example 2) every shot were examined. The unit weight variation of each shot was defined by dividing a difference between the maximum weight and the minimum weight of four samples in each shot by an average weight of the four samples, and representing the thus obtained value by percentage. Table 2 shows the minimum and maximum values of the unit weight variation for forty shots.

TABLE 2

| | Minimum value of unit weight variation | Maximum value of unit weight variation |
|---|---|---|
| Example 2 | 1.5% | 2.8% |
| Comparative Example 2 | 2.9% | 6.2% |

As can be seen from Table 2, the use of the press molding device in the magnetic field in the present invention (Example 2) drastically decreases the unit weight variation of the sintered compact as compared to the use of the press molding device in the magnetic field shown in FIG. 5 (Comparative Example 2). As a result, the use of the press molding device in the magnetic field according to the present invention can stably mold the molded bodies with little unit weight variation even though the large magnetic field exceeding 1.5 T or more is applied during the press molding in the magnetic field.

This application claims priority on Japanese Patent Application No. 2012-179163, the disclosure of which is incorporated by reference herein.

DESCRIPTION OF REFERENCE NUMERALS

1 Upper punch
3*a*, 3*b*, 3*c*, 3*d* Lower punch
5 Die
7*a* First electromagnet
7*b* Second electromagnet
8*a*, 8*b* Space (Hollow)
9*a*, 9*b*, 9*c*, 9*d* Cavity
11*a*, 11*b*, 11*c*, 11*d* Dispersion medium outlet
13 Filter
15*a*, 15*b*, 15*c*, 15*d* Slurry supply path
17*a*, 17*b* Slurry flow path
21 Alloy powder
23 Dispersion medium
25 Slurry
27 Cake layer

The invention claimed is:

1. A method for producing a rare earth sintered magnet, comprising the steps of:

1) preparing a slurry including an alloy powder and a dispersion medium, the alloy powder containing a rare earth element;
2) disposing an upper punch and a lower punch in respective through holes provided in a die, thereby preparing a plurality of cavities enclosed by the die, and the upper punch and the lower punch, at least one of the upper punch and the lower punch being movable toward and away from the other one, at least one of the upper punch and the lower punch including an outlet for discharging the dispersion medium of the slurry;
3) applying a magnetic field exceeding 1.0 T in each of the cavities by using a first electromagnet having an air core of a coil, and a second electromagnet having an air core of a coil and opposed to and spaced from the first electromagnet in a direction substantially parallel to a direction in which at least one of the upper punch and the lower punch is movable, and then supplying the slurry in a plurality of slurry supply paths through a slurry flow path disposed between the first electromagnet and the second electromagnet and having a bent portion between a coil portion of the first electromagnet and a coil portion of the second electromagnet, and supplying the slurry into the plurality of cavities via the plurality of slurry supply paths, the plurality of slurry supply paths linearly extending from an outer peripheral side surface of the die to each of the cavities without being branched;
4) producing a molded body of the alloy powder in each of the cavities by press molding in the magnetic field, the upper punch and the lower punch coming closer to each other while applying the magnetic field; and
5) sintering the molded body;

wherein, in the step 3), the slurry is supplied into each of the plurality of the cavities at a flow rate of 20 to 600 $cm^3$/second.

2. The production method according to claim 1, wherein a strength of the magnetic field is 1.5 T or more.

* * * * *